US011503877B2

(12) United States Patent
Meschter et al.

(10) Patent No.: US 11,503,877 B2
(45) **Date of Patent: *Nov. 22, 2022**

(54) ARTICLE OF FOOTWEAR AND SOLE STRUCTURE WITH A CENTRAL FOREFOOT RIDGE ELEMENT

(71) Applicant: NIKE, Inc., Beaverton, OR (US)

(72) Inventors: James C. Meschter, Portland, OR (US); Kevin W. Hoffer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/209,089

(22) Filed: Mar. 22, 2021

(65) Prior Publication Data

US 2021/0204650 A1 Jul. 8, 2021

Related U.S. Application Data

(63) Continuation of application No. 15/061,224, filed on Mar. 4, 2016, now Pat. No. 10,980,313.

(51) Int. Cl.

| | |
|---|---|
| ***A43B 13/18*** | (2006.01) |
| ***A43B 7/1445*** | (2022.01) |
| ***A43B 13/12*** | (2006.01) |
| ***A43B 7/1455*** | (2022.01) |
| ***A43B 13/14*** | (2006.01) |
| ***A43B 13/16*** | (2006.01) |

(52) U.S. Cl.

CPC ..... *A43B 13/184* (2013.01); *A43B 7/146* (2013.01); *A43B 7/1445* (2013.01); *A43B 13/122* (2013.01); *A43B 13/141* (2013.01); *A43B 13/145* (2013.01); *A43B 13/16* (2013.01)

(58) Field of Classification Search

CPC .... A43B 13/145; A43B 13/181; A43B 13/184

See application file for complete search history.

(56) References Cited

U.S. PATENT DOCUMENTS 4,060,917 A 12/1977 Canale
RE33,066 E * 9/1989 Stubblefield ..... A43B 13/184 36/83

(Continued)

FOREIGN PATENT DOCUMENTS

CN 2015095237 U 10/2010
CN 104640467 A 5/2015

(Continued)

OTHER PUBLICATIONS

International Search Report and Written Opinion, dated May 17, 2017, for corresponding International Patent Application No. PCT/US2017/019177, 10 pages.

(Continued)

*Primary Examiner* — Jillian K Pierorazio
(74) *Attorney, Agent, or Firm* — Klarquist Sparkman, LLP

(57) ABSTRACT

An article of footwear including a sole structure attached to an upper defining an internal void configured to receive a foot of a wearer is described. The sole structure includes a sole body portion having a central ridge element located in an aperture in the sole body portion and the central ridge element is configured to contact the ground and move relative to the aperture.

18 Claims, 15 Drawing Sheets

(56) References Cited

U.S. PATENT DOCUMENTS

| | | | | |
|---|---|---|---|---|
| 4,887,367 | A | 12/1989 | Mackness et al. | |
| 4,897,936 | A * | 2/1990 | Fuerst | A43B 13/223 36/31 |
| 4,972,611 | A | 11/1990 | Swartz et al. | |
| D397,237 | S | 8/1998 | Tracy | |
| 5,862,614 | A * | 1/1999 | Koh | A43B 13/223 36/31 |
| 6,082,024 | A * | 7/2000 | Del Biondi | A43B 7/14 601/134 |
| D448,919 | S | 10/2001 | Montross et al. | |
| D453,872 | S | 2/2002 | White | |
| D453,874 | S | 2/2002 | Frase | |
| 6,920,707 | B1 | 7/2005 | Greene et al. | |
| 7,013,588 | B2 | 3/2006 | Chang | |
| 7,069,672 | B2 | 7/2006 | Hahn | |
| 7,140,129 | B2 | 11/2006 | Clarke et al. | |
| 7,313,875 | B2 | 1/2008 | Morgan | |
| 7,549,236 | B2 | 6/2009 | Dillon et al. | |
| 7,681,333 | B2 | 3/2010 | Clark et al. | |
| 7,882,648 | B2 | 2/2011 | Langvin | |
| 7,966,748 | B2 | 6/2011 | Votolato | |
| 8,074,376 | B1 | 12/2011 | Teteriatnikov | |
| D652,614 | S | 1/2012 | Raysse | |
| 8,256,145 | B2 | 9/2012 | Baucom et al. | |
| 8,333,022 | B2 | 12/2012 | Crowley et al. | |
| 8,341,855 | B2 | 1/2013 | Teteriatnikov | |
| D708,831 | S | 7/2014 | Petrie | |
| 8,763,276 | B2 | 7/2014 | Greene et al. | |
| 8,763,277 | B2 | 7/2014 | Sartor | |
| D719,329 | S | 12/2014 | Smith et al. | |
| 8,914,993 | B2 | 12/2014 | Hay et al. | |
| D723,773 | S | 3/2015 | Raysse | |
| D723,774 | S | 3/2015 | Raysse | |
| D723,788 | S | 3/2015 | Raysse | |
| 9,144,264 | B2 | 9/2015 | Marvin et al. | |
| 9,161,591 | B2 | 10/2015 | Shrairman et al. | |
| 9,516,918 | B2 | 12/2016 | Meschter et al. | |
| 10,856,612 | B2 * | 12/2020 | Heard | A43B 13/187 |
| 2002/0078598 | A1 | 6/2002 | Bell | |
| 2008/0127515 | A1 * | 6/2008 | Lohrer | A43B 13/145 36/43 |
| 2009/0038180 | A1 | 2/2009 | Jacob | |
| 2009/0044432 | A1 | 2/2009 | O'Connor et al. | |
| 2010/0083541 | A1 | 4/2010 | Baucom et al. | |
| 2010/0251565 | A1 * | 10/2010 | Litchfield | A43B 13/203 36/35 B |
| 2011/0072684 | A1 | 3/2011 | Stubblefield | |
| 2011/0126422 | A1 * | 6/2011 | Vattes | A43B 13/145 36/28 |
| 2011/0138657 | A1 * | 6/2011 | Christensen | A43B 3/108 36/114 |
| 2011/0192056 | A1 | 8/2011 | Geser et al. | |
| 2012/0073160 | A1 * | 3/2012 | Marvin | A43B 13/188 36/28 |
| 2012/0167414 | A1 | 7/2012 | Shrairman | |
| 2013/0031804 | A1 * | 2/2013 | Abshire | A43B 7/144 36/103 |
| 2013/0212909 | A1 | 8/2013 | Bates et al. | |
| 2014/0013617 | A1 | 1/2014 | Montross et al. | |
| 2014/0325871 | A1 | 11/2014 | Price et al. | |
| 2015/0068063 | A1 | 3/2015 | Farris | |
| 2015/0128455 | A1 | 5/2015 | Lubart | |
| 2015/0143714 | A1 | 5/2015 | Tzeng | |
| 2015/0157089 | A1 | 6/2015 | Schumacher et al. | |
| 2015/0196082 | A1 | 7/2015 | Van Atta | |
| 2015/0196087 | A1 * | 7/2015 | Meschter | A43C 15/168 36/25 R |
| 2015/0272271 | A1 | 10/2015 | Campos, II et al. | |
| 2015/0282561 | A1 | 10/2015 | Swager | |
| 2015/0313310 | A1 | 11/2015 | Okamoto et al. | |
| 2016/0192739 | A1 | 7/2016 | Hoffer et al. | |
| 2016/0302522 | A1 * | 10/2016 | Meschter | A43B 13/181 |
| 2018/0098601 | A1 | 4/2018 | Hartenstein et al. | |
| 2019/0053567 | A1 | 2/2019 | Thomas | |

FOREIGN PATENT DOCUMENTS

| | | |
|---|---|---|
| DE | 20 2006 016038 | 1/2007 |
| EP | 0334781 | 9/1989 |
| JP | H05115308 A | 5/1993 |
| JP | 3082440 U | 12/2001 |
| KR | 10-0870929 B1 | 11/2008 |
| WO | WO 2010/137068 | 12/2010 |
| WO | WO 2014/046915 | 3/2014 |

OTHER PUBLICATIONS

Office Action, dated Dec. 20, 2017, for corresponding Taiwanese Patent Application No. 106107103, 13 pages (with English translation).

* cited by examiner

ARTICLE OF FOOTWEAR AND SOLE STRUCTURE WITH A CENTRAL FOREFOOT RIDGE ELEMENT

CROSS REFERENCE TO RELATED APPLICATION

This application is a continuation of U.S. patent application Ser. No. 15/061,224, filed Mar. 4, 2016, which is incorporated herein by reference in its entirety.

BACKGROUND

The present disclosure is directed to an article of footwear and, more particularly, to an article of footwear and a sole structure having ridge elements located along a sole perimeter.

Conventional articles of athletic footwear include two primary elements, an upper and a sole structure. The upper provides a covering for the foot that comfortably receives and securely positions the foot with respect to the sole structure. The sole structure is secured to a lower portion of the upper and is generally positioned between the foot and the ground. In addition to attenuating ground reaction forces (that is, providing cushioning) during walking, running, and other ambulatory activities, the sole structure may influence foot motions (for example, by resisting pronation), impart stability, and provide traction, for example. Accordingly, the upper and the sole structure operate cooperatively to provide a comfortable structure that is suited for a wide variety of athletic activities.

The upper is often formed from a plurality of material elements (for example, textiles, polymer sheets, foam layers, leather, and synthetic leather) that are stitched or adhesively bonded together to define a void or cavity on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permit entry and removal of the foot from the void within the upper. In addition, the upper may include a tongue that extends under the lacing system to enhance adjustability and comfort of the footwear, and the upper may incorporate a heel counter or other stabilizing structure.

In some cases, cushioning provided by a sole structure, while attenuating ground reaction forces, may undesirably reduce sensory feedback by isolating the foot of the wearer from the ground contact. Therefore, there exists a need in the art for a sole structure that includes provisions for increasing sensory feedback to a foot of a wearer.

SUMMARY

In one aspect, the invention provides a sole structure for an article of footwear. The sole structure comprises a sole body portion. The sole body portion includes an outsole surface facing away from the article of footwear and an upper surface disposed opposite the outsole surface. The sole structure also comprises a central ridge element disposed within an aperture in the sole body portion. The aperture can be located within a forefoot region and extending in a longitudinal direction to a midfoot region of the sole structure and located between a medial side and a lateral side of the sole structure. The central ridge element includes a bottom surface configured to engage a ground surface and a top surface disposed opposite the bottom surface. The bottom surface of the central ridge element extends above the outsole surface of the sole body portion when the central ridge element is in an uncompressed condition. The central ridge element is configured to move vertically within the aperture in the sole body portion so that the bottom surface of the central ridge element moves closer towards the outsole surface of the sole body portion when the central ridge element is in a compressed condition.

In another aspect, the invention provides an article of footwear. The article of footwear comprises an upper and a sole structure joined to the upper. The sole structure comprises a sole body portion. The sole body portion includes an outsole surface facing away from the article of footwear and an upper surface disposed opposite the outsole surface. The sole structure also comprises a central ridge element disposed within an aperture in the sole body portion. The aperture can be located within a forefoot region and extending in a longitudinal direction to a midfoot region of the sole structure and located between a medial side and a lateral side of the sole structure. The central ridge element includes a bottom surface configured to engage a ground surface and a top surface disposed opposite the bottom surface. The bottom surface of the central ridge element extends above the outsole surface of the sole body portion when the central ridge element is in an uncompressed condition. The top surface of the central ridge element extends towards an interior of the upper above the upper surface of the sole body portion when the central ridge element is in a compressed condition.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
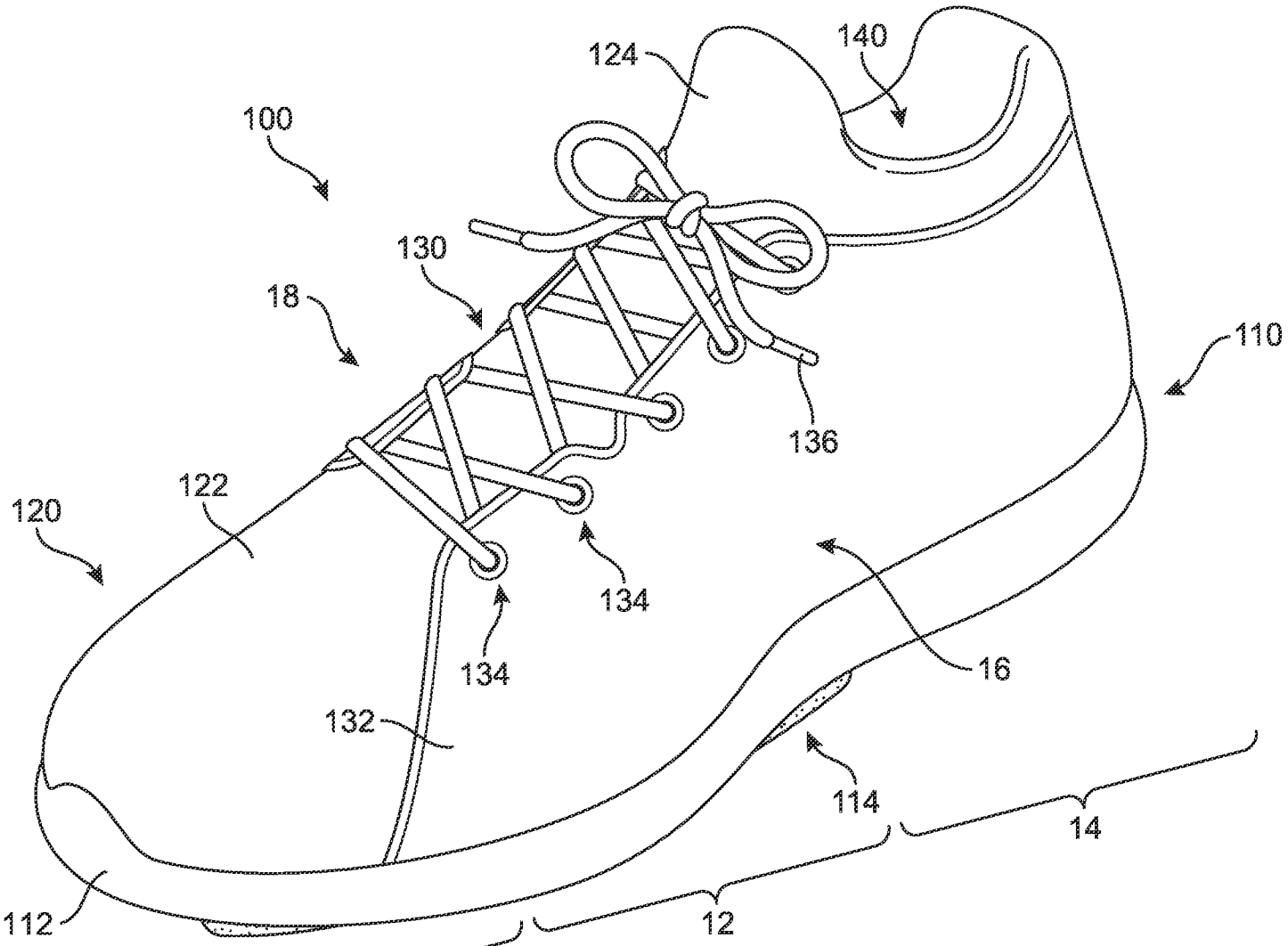
FIG. 1 is an isometric view of an article of footwear including an exemplary embodiment of a sole structure having a central ridge element.

The following discussion and accompanying figures disclose an article of footwear and a sole structure for an article of footwear. Concepts associated with the article of footwear disclosed herein may be applied to a variety of athletic footwear types, including skateboarding shoes, performance driving shoes, soccer shoes, running shoes, baseball shoes, basketball shoes, cross-training shoes, cycling shoes, football shoes, golf shoes, tennis shoes, walking shoes, and hiking shoes and boots, for example. The concepts may also be applied to footwear types that are generally considered to be non-athletic, including dress shoes, loafers, sandals, and work boots. Accordingly, the concepts disclosed herein apply to a wide variety of footwear types.

For consistency and convenience, directional adjectives are employed throughout this detailed description corresponding to the illustrated embodiments. The term "longitudinal," as used throughout this detailed description and in the claims, refers to a direction extending a length of a sole structure, i.e., extending from a forefoot region to a heel region of the sole structure. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a sole structure. In other words, the lateral direction may extend between a medial side and a lateral side of an article of footwear, with the lateral side of the article of footwear being the surface that faces away from the other foot, and the medial side being the surface that faces toward the other foot.

The term "horizontal," as used throughout this detailed description and in the claims, refers to any direction substantially parallel with the ground, including the longitudinal direction, the lateral direction, and all directions in between. Similarly, the term "side," as used in this specification and in the claims, refers to any portion of a component facing generally in a lateral, medial, forward, and/or rearward direction, as opposed to an upward or downward direction.

The term "vertical," as used throughout this detailed description and in the claims, refers to a direction generally perpendicular to both the lateral and longitudinal directions. For example, in cases where a sole structure is planted flat on a ground surface, the vertical direction may extend from the ground surface upward. It will be understood that each of these directional adjectives may be applied to an article of footwear, a sole structure, and individual components of a sole structure. The term "upward" refers to the vertical direction heading away from a ground surface, while the term "downward" refers to the vertical direction heading towards the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

FIGS. 1 through 12 illustrate an exemplary embodiment of an article of footwear 100, also referred to simply as article 100. In some embodiments, article of footwear 100 may include a sole structure 110 and an upper 120. For reference purposes, article 100 may be divided into three general regions: a forefoot region 10, a midfoot region 12, and a heel region 14, as shown in FIGS. 1-4. Forefoot region 10 generally includes portions of article 100 corresponding with the toes and the joints connecting the metatarsals with the phalanges. Midfoot region 12 generally includes portions of article 100 corresponding with an arch area of the foot. Heel region 14 generally corresponds with rear portions of the foot, including the calcaneus bone. Article 100 also includes a lateral side 16 and a medial side 18, which extend through each of forefoot region 10, midfoot region 12, and heel region 14 and correspond with opposite sides of article 100. More particularly, lateral side 16 corresponds with an outside area of the foot (i.e., the surface that faces away from the other foot), and medial side 18 corresponds with an inside area of the foot (i.e., the surface that faces toward the other foot). Forefoot region 10, midfoot region 12, and heel region 14 and lateral side 16, medial side 18 are not intended to demarcate precise areas of article 100. Rather, forefoot region 10, midfoot region 12, and heel region 14 and lateral side 16, medial side 18 are intended to represent general areas of article 100 to aid in the following discussion. In addition to article 100, forefoot region 10, midfoot region 12, and heel region 14 and lateral side 16, medial side 18 may also be applied to sole structure 110, upper 120, and individual elements thereof.

In an exemplary embodiment, sole structure 110 is secured to upper 120 and extends between the foot and the ground when article 100 is worn. Upper 120 defines an interior void within article 100 for receiving and securing a foot relative to sole structure 110. The void is shaped to accommodate the foot and extends along a lateral side of the foot, along a medial side of the foot, over the foot, around the heel, and under the foot. Upper 120 may also include a collar that is located in at least heel region 14 and forms a throat opening 140. Access to the interior void of upper 120 is provided by throat opening 140. More particularly, the foot may be inserted into upper 120 through throat opening 140, and the foot may be withdrawn from upper 120 through throat opening 140.

In an exemplary embodiment, upper 120 may be formed from a bootie 122. Bootie 122 can be a one-piece element that entirely covers the top, sides and bottom of a foot of a wearer. The various portions of upper 120, including bootie 122, may be formed from one or more of a plurality of material elements (e.g., textiles, polymer sheets, foam layers, leather, synthetic leather) that can form the majority of upper 120 or portions can be stitched or bonded together to form upper 120 defining the void within article 100. In one embodiment, bootie 122 can form a majority of an exterior surface of upper 122. In other embodiments, upper 120 may be a conventional upper formed by multiple material element portions and can include edges that are attached to a sockliner or strobel sock to extend under the foot and close the interior void of the upper 120.

In some embodiments, article 100 can include a lacing system 130. Lacing system 130 extends forward from collar and throat opening 140 in heel region 14 over an area corresponding to an instep of the foot in midfoot region 12 to an area adjacent to forefoot region 10. Lacing system 130 includes various components configured to secure a foot within upper 120 of article 100 and, in addition to the components illustrated and described herein, may further include additional or optional components conventionally included with footwear uppers. In this embodiment, a lace 136 extends through various lace-receiving elements to permit the wearer to modify dimensions of upper 120 to accommodate the proportions of the foot. In the exemplary embodiments, lace-receiving elements are configured as a plurality of lace apertures 134. More particularly, lace 136 permits the wearer to tighten upper 120 around the foot, and lace 136 permits the wearer to loosen upper 120 to facilitate entry and removal of the foot from the interior void (i.e., through ankle opening 140). Lace 136 is shown in FIG. 1, but has been omitted from the remaining Figures for ease of illustration of the remaining components of article 100.

As an alternative to plurality of lace apertures 134, upper 120 may include other lace-receiving elements, such as loops, eyelets, and D-rings. In addition, upper 120 includes a tongue 124 that extends over a foot of a wearer when disposed within article 100 to enhance the comfort of article 100. In this embodiment, tongue 124 is integrally formed with bootie 122. In other embodiments, tongue 124 may be an individual component that may move within an opening between opposite lateral and medial sides of upper 120.

In one embodiment, lacing system 130 may further include a support wrap 132. Support wrap 132 extends over the outside of bootie 122 and includes lace apertures 134. In exemplary embodiments, support wrap 132 extends between a lower area of upper 120 where upper 120 and sole structure 110 are joined and a lacing area where lace 136 extends through lace apertures 134 over the top of upper 120. With this configuration, lace apertures 134 of lacing system 130 may be provided on support wrap 132 separate from bootie 122 to allow bootie 122 to have a construction without any lace-receiving elements. In other embodiments, one or more lace-receiving elements, including lace apertures 134, may be located instead, or additionally, on bootie 122 of upper 120.

In some embodiments, sole structure 110 may include multiple components, which may individually and/or collectively provide article 100 with a number of attributes, such as support, rigidity, flexibility, stability, cushioning, comfort, reduced weight, traction, and/or other attributes. In various athletic activities, execution of skills involved in such athletic activities may be performed based on precise placement and interaction of the wearer's feet with the surface on which the activities are performed. Therefore, typical cushioning found in the sole structure of footwear used in such activities may reduce the amount of sensory feedback that the wearer can feel from the surface through the soles of the footwear. This can adversely affect their ability to position their feet and interact with the surface on which the activity is performed. For example, in sports and other athletic activities where weight transfer or cutting motions are commonly performed, sensory feedback to the wearer's foot about the condition of the surface and the amount of grip or force being applied at various locations across the wearer's foot can be helpful to the wearer.

In an exemplary embodiment, article 100 includes sole structure 110 having a sole body portion 112 and a central ridge element 114. Central ridge element 114 is located within at least forefoot region 10 and a portion of midfoot region 12 of sole structure 110 and approximately centrally located between lateral side 16 and medial side 18 of sole structure 110 to provide sensory feedback to a wearer's foot for assisting with athletic activities. Additionally, central ridge element 114 can also provide a "push-off" surface for a wearer's foot within an interior of the article of footwear.

In exemplary embodiments, components of sole structure 110 may be formed of suitable materials for achieving the desired performance attributes. Sole body portion 112 may be formed of any suitable rubber, polymer, composite, and/or metal alloy materials. Exemplary materials may include thermoplastic and thermoset polyurethane, polyester, nylon, polyether block amide, alloys of polyurethane and acrylonitrile butadiene styrene, carbon fiber, poly-paraphenylene terephthalamide (para-aramid fibers, e.g., Kevlar®), titanium alloys, and/or aluminum alloys. In some embodiments, sole body portion 112 may be fashioned from a durable and wear-resistant material (for example, rubber). Other suitable materials will be recognized by those having skill in the art.

In some embodiments, central ridge element 114 may be made of a similar material as sole body portion 112, including any of the materials suitable for sole structure 110, described above. In an exemplary embodiment, central ridge element 114 may be made from a material that has a lower density or lesser hardness than sole body portion 112. For example, in some embodiments, central ridge element 114 may be formed from a resilient polymer foam material, such as polyurethane (PU) or ethyl vinyl acetate (EVA). In other embodiments, central ridge element 114 may be formed from a less dense rubber or polymer material than sole body portion 112. In still other embodiments, central ridge element 114 and sole body portion 112 may be formed by the same material.

Figure 2:
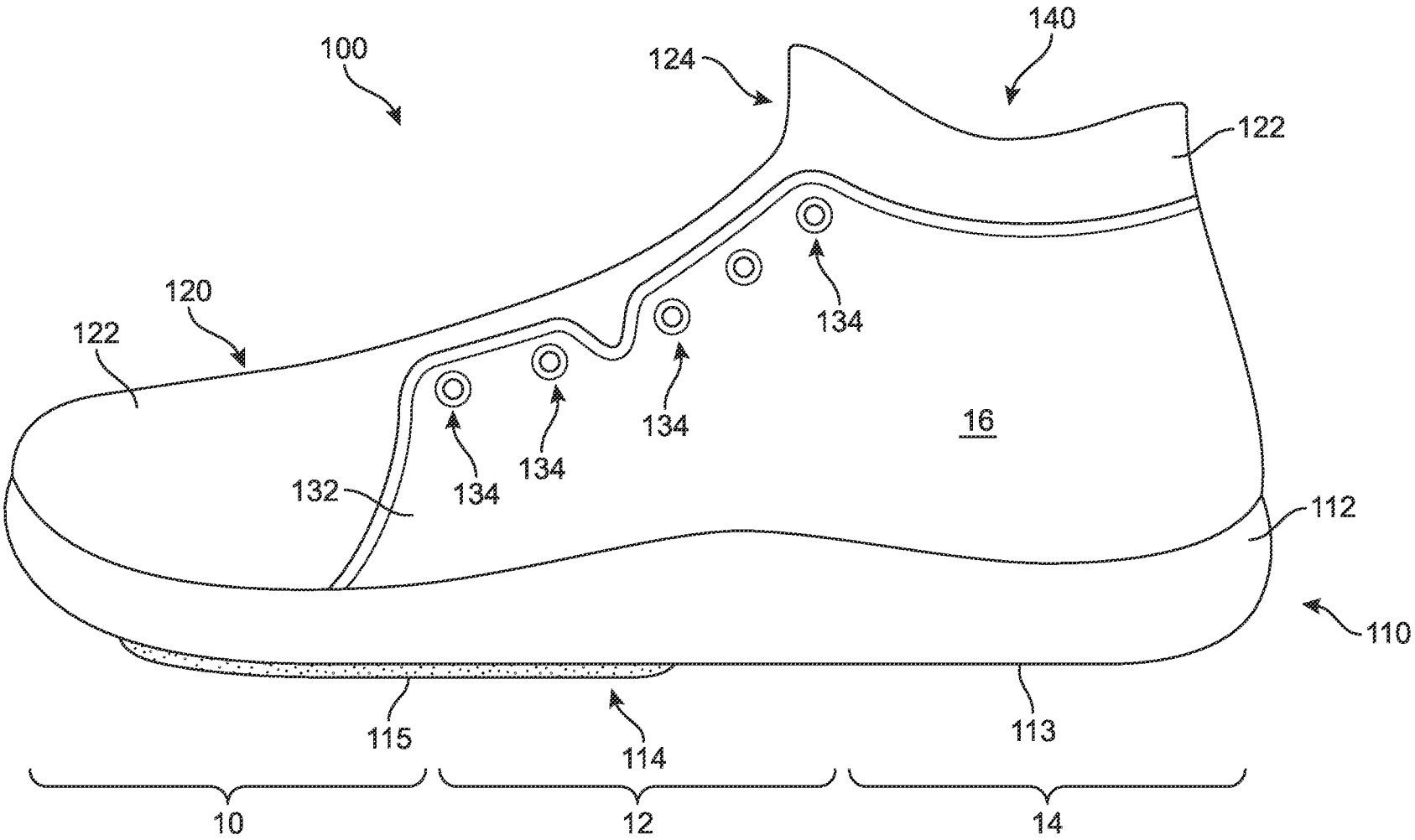
FIG. 2 is a lateral side view of the article of footwear including an exemplary embodiment of a sole structure having a central ridge element.
Figure 3:
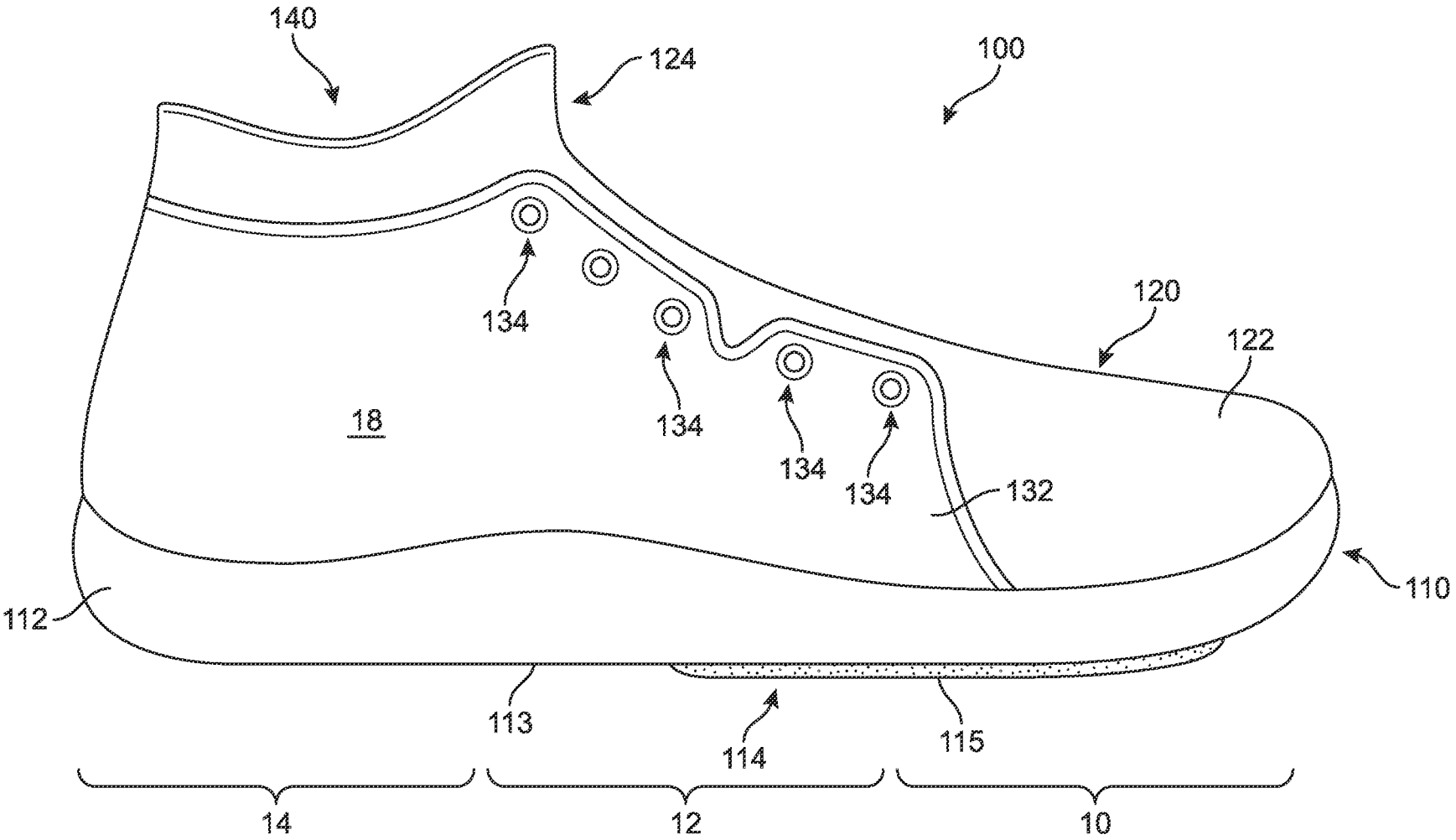
FIG. 3 is a medial side view of the article of footwear including an exemplary embodiment of a sole structure having a central ridge element.

FIGS. 1-3 illustrate different views of article 100. As shown in FIG. 1, sole structure 110 may include central ridge element 114. Central ridge element 114 may be exposed through aperture 210 (shown in FIGS. 6-14) in sole body portion 112. Accordingly, a portion of central ridge element 114 may be exposed to the exterior of article 100 and configured to contact the ground. In this embodiment, a bottom surface 115 of central ridge element 114 is oriented to be the ground-engaging surface of central ridge element 114. An opposite top surface 116 (shown in FIG. 5) of central ridge element 114 is disposed facing away from the ground and towards the interior of upper 120.

In an exemplary embodiment, sole body portion 112 includes a lower outsole surface 113 that is also exposed to the exterior of article 100 and configured to contact the ground. An opposite upper surface 111 of sole body portion 112 is disposed facing away from the ground and towards the interior of upper 120, in a similar orientation as top surface 116 of central ridge element 114.

In some embodiments, sole structure 110 includes central ridge element 114 that is approximately centrally located within sole structure 110. In one embodiment, central ridge element 114 is approximately evenly spaced from perimeter edges of article 100 on lateral side 16 and medial side 18 across the lateral direction of article 100. In some embodiments, central ridge element 114 may extend from an area near a toe end in forefoot region 10 along a longitudinal direction towards a heel end of sole structure 110 and into a portion of midfoot region 12 of article 100. In one embodiment, central ridge element 114 may extend approximately half the longitudinal length of sole structure 110 from the toe end of sole structure 110 and partially into midfoot region 12 to locate central ridge element 114 beneath a ball of the foot, portions of the metatarsals of the foot, and/or an arch of the foot of the wearer.

With this arrangement, central ridge element 114 may be located at an approximately central location in forefoot region 10 and portions of midfoot region 12 of sole structure 110 so as to provide sensory feedback of the orientation and direction of forces relative to a wearer's foot. That is, by providing central ridge element 114 centrally located between lateral side 16 and medial side 18 on sole structure 110, sensory feedback regarding about the direction and orientation felt during a sport or athletic activity can be provided to the wearer to assist with locating and determining relative motion and force balance under his or her foot. In this manner, central ridge element 114 may act as a directional force indicator that is used as reference for the foot to determine lateral and medial motion relative to the location of central ridge element 114. This type of sensory feedback may be helpful in assisting a wearer in determining the orientation and direction of forces of the foot over the sole structure of the article of footwear before making any additional athletic moves or motions.

In the exemplary embodiment shown in FIGS. 1-12, central ridge element 114 is located within forefoot region 10 and at least a portion of midfoot region 12 of sole structure 110 and is approximately centrally located between lateral side 16 and medial side 18 of sole structure 110. In other embodiments, the location of central ridge element 114 may be varied between lateral side 16 and medial side 18 across the lateral direction of article 100 or between the toe end and heel end of sole structure 110 along the longitudinal direction of article 100. For example, the location may be varied slightly so as to align with a portion of the foot of a wearer that has more sensitivity to receive sensory feedback from central ridge element 114 than other portions of the foot.

Referring to FIG. 2, lateral side 16 of article 100 is illustrated. Referring now to FIG. 3, medial side 18 of article 100 is illustrated. In these embodiments, sole body portion 112 surrounds central ridge element 114 on all sides and extends laterally from aperture 210 in sole body portion 112 to each of the medial and lateral perimeter edges. Sole body portion 112 also extends longitudinally from a bottom end of aperture 210 rearward to the heel end of sole structure 110 and forward from a top end of aperture 210 to the toe end of sole structure 110. With this arrangement, central ridge element 114 disposed in aperture 210 in sole body portion 112 is surrounded on all sides by sole body portion 112 that extends to the perimeter edges in the lateral direction and the opposite toe and heel ends in the longitudinal direction.

In different embodiments, the sizing of the central ridge element may vary in order to provide desired performance for the activity for which article 100 is to be used. In an exemplary embodiment, central ridge element 114 has a generally rectangular shape, with a length aligned along the longitudinal direction of article 100 that is larger than a width aligned along the lateral direction of article 100. The length and width of central ridge element 114 may be selected so as to be sufficiently large to provide sensory feedback to a wearer's foot. In one embodiment, central ridge element 114 may have a width of approximately 1 inch. An exemplary range of widths that are suitable for providing sensory feedback may be approximately from 0.75 inches to 1.5 inches. In some embodiments, central ridge element 114 may have a length that is approximately half the longitudinal length of sole structure 110. For example, in one embodiment, central ridge element 114 may have a length of approximately 5 inches. An exemplary range of lengths that are suitable for providing sensory feedback may be approximately from 2.5 inches to 6 inches. It should be understood that the length of central ridge element 114 may vary in relation to the size of the particular article of footwear and sole structure. A smaller sized article of footwear can have a central ridge element with a smaller length and a larger sized article of footwear can have a central ridge element with a larger length. In some cases, the width or length may be larger or smaller.

In other embodiments, the size of the length and/or width of central ridge element 114 may be different in various embodiments, depending on the sensitivity of the portion of the foot where sensory feedback is desired. For example, in a location where the foot is more sensitive, a smaller length and/or width for the central ridge element may be provided, whereas in a location where the foot is less sensitive, a larger length and/or width central ridge element can be provided to increase the ability of the central ridge element to effectively provide sensory feedback to the wearer's foot.

Figure 4:
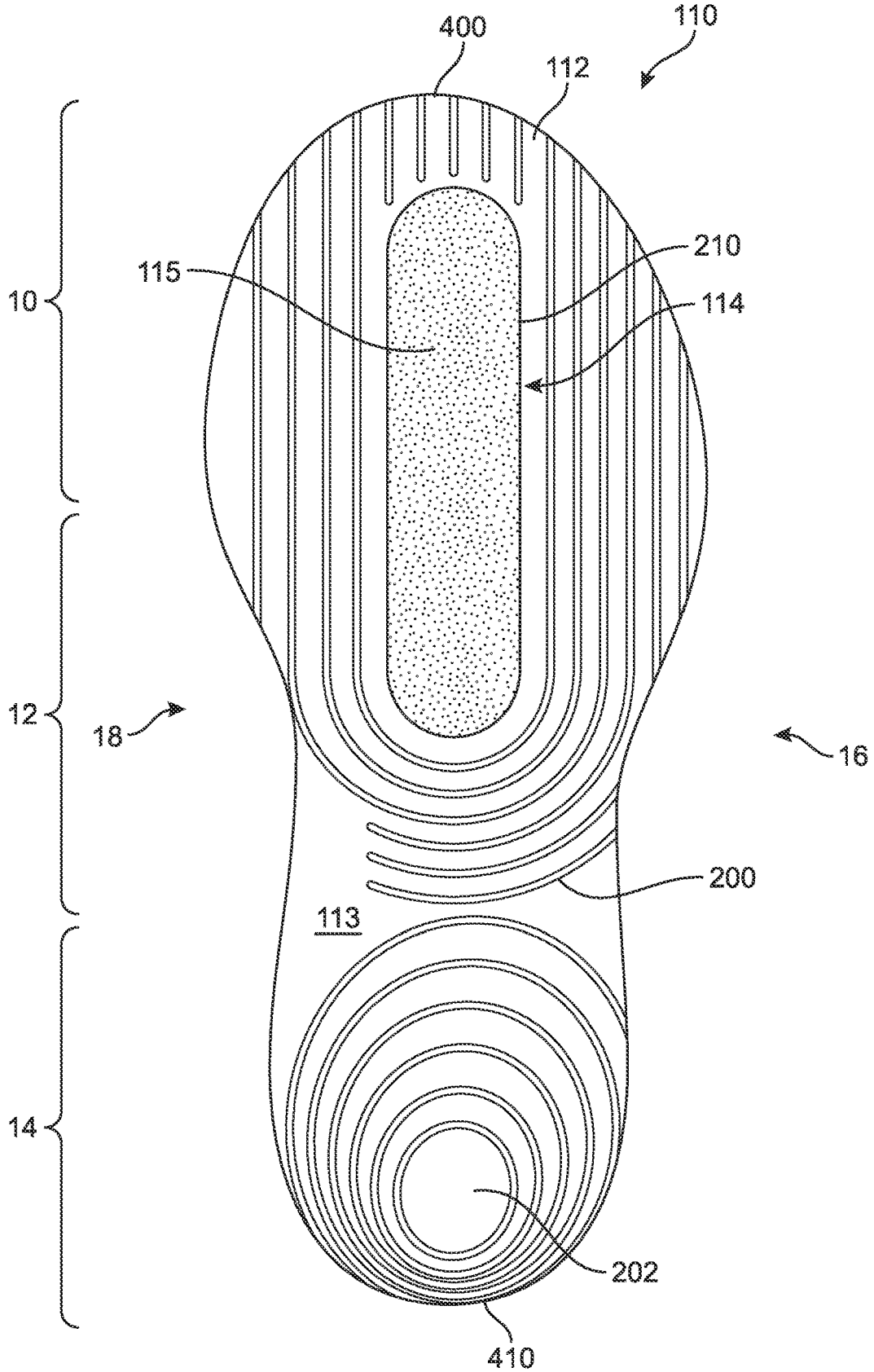
FIG. 4 is a bottom view of the exemplary embodiment of a sole structure having a central ridge element.

FIG. 4 illustrates a bottom view of the underside of sole structure 110 of article 100. Sole structure 110 extends along a longitudinal length of article 100 between a toe end 400 located at the front of forefoot region 10 to a heel end 410 located at the rear of heel region 14. In an exemplary embodiment, central ridge element 114 is located approximately evenly spaced between the perimeter edges of lateral side 16 and medial side 18 within forefoot region 10 and a portion of midfoot region 12. In other embodiments, the location of central ridge element 114 may be varied in the lateral direction and/or the longitudinal direction along sole structure 110.

In one embodiment, central ridge element 114 may be surrounded by sole body portion 112 in all directions. For example, outsole surface 113 of sole body portion 112 may be exposed in the lateral direction from aperture 210 towards medial side 18 and lateral side 16 of sole structure 110. Outsole surface 113 of sole body portion 112 also may be exposed in the longitudinal direction from either end of aperture 210 towards toe end 400 and heel end 410 of sole structure 110. Together, outsole surface 113 of sole body portion 112 and bottom surface 115 of central ridge element 114 can provide traction or grip to sole structure 110 of article 100.

In some embodiments, outsole surface 113 may further include additional features that assist with providing traction to sole structure 110. In one embodiment, a plurality of grooves 200 is disposed at various locations in outsole surface 113 of sole body portion 112. Plurality of grooves 200 can be depressions or recesses in sole body portion 112 that extend below surrounding outsole surface 113. In this embodiment, plurality of grooves 200 is arranged in one or more approximately parallel or concentric arrangements, with each groove being substantially evenly spaced apart from adjacent grooves. With this configuration, outsole surface 113 of sole body portion 112 may assist with providing traction or grip to article 100.

In some embodiments, sole structure 110 may also include one or more traction members located in portions of sole structure 110. In an exemplary embodiment, a heel traction member 202 may be located in heel region 14 of sole structure 110. Heel traction member 202 may be a raised portion of sole structure 110 extending above outsole surface 113 so as to provide additional traction and grip to sole structure 110. In an exemplary embodiment, heel traction member 202 is a round or oval shaped raised area of sole structure 110 that extends above outsole surface 113 to provide additional traction or grip to article 100. In addition, in some embodiments, plurality of grooves 200 may also be arranged in an approximately concentric arrangement around heel traction member 202.

Figure 5:
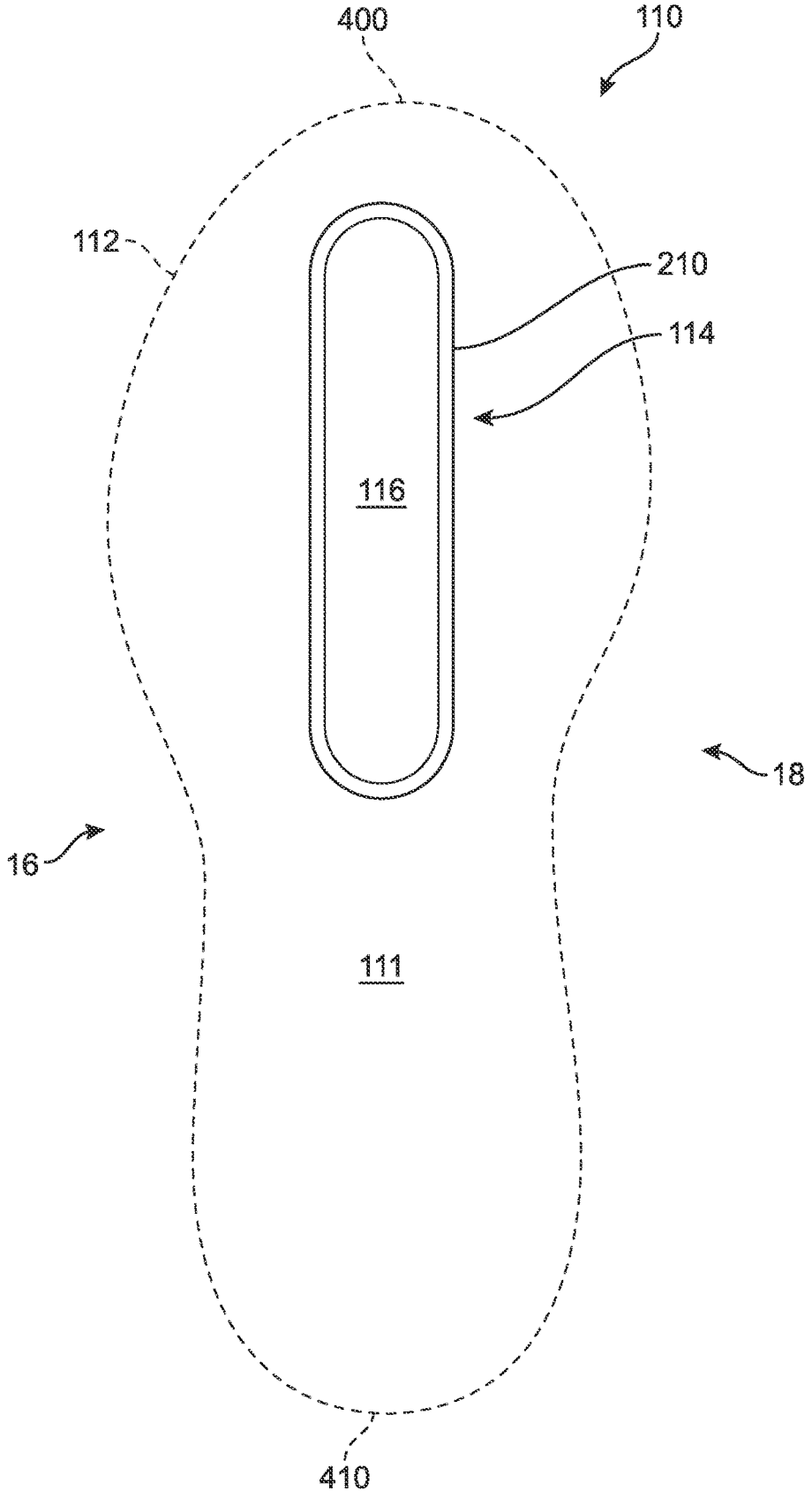
FIG. 5 is a schematic top down view showing the location of the central ridge element with the remaining portion of the sole structure shown in outline.

FIG. 5 illustrates an interior top down view of the inner side of sole structure 110 of article 100, with upper 120 and sole body portion 112 shown in outline. In some embodiments, central ridge element 114 may have a top surface 116 located at a top end where the central ridge element has a smaller perimeter circumference than an opposite bottom end where bottom surface 115 is located. As will be further described below, top surface 116 of central ridge element 114 is attached to a base layer 128 of upper 120. In this case, base layer 128 is a bottom portion of bootie 122 that extends under a foot of a wearer. In other cases, where article 100 includes other embodiments of upper 120, base layer 128 may be formed by a sockliner, a strobel sock, or an insole that encloses upper 120.

Figure 6:
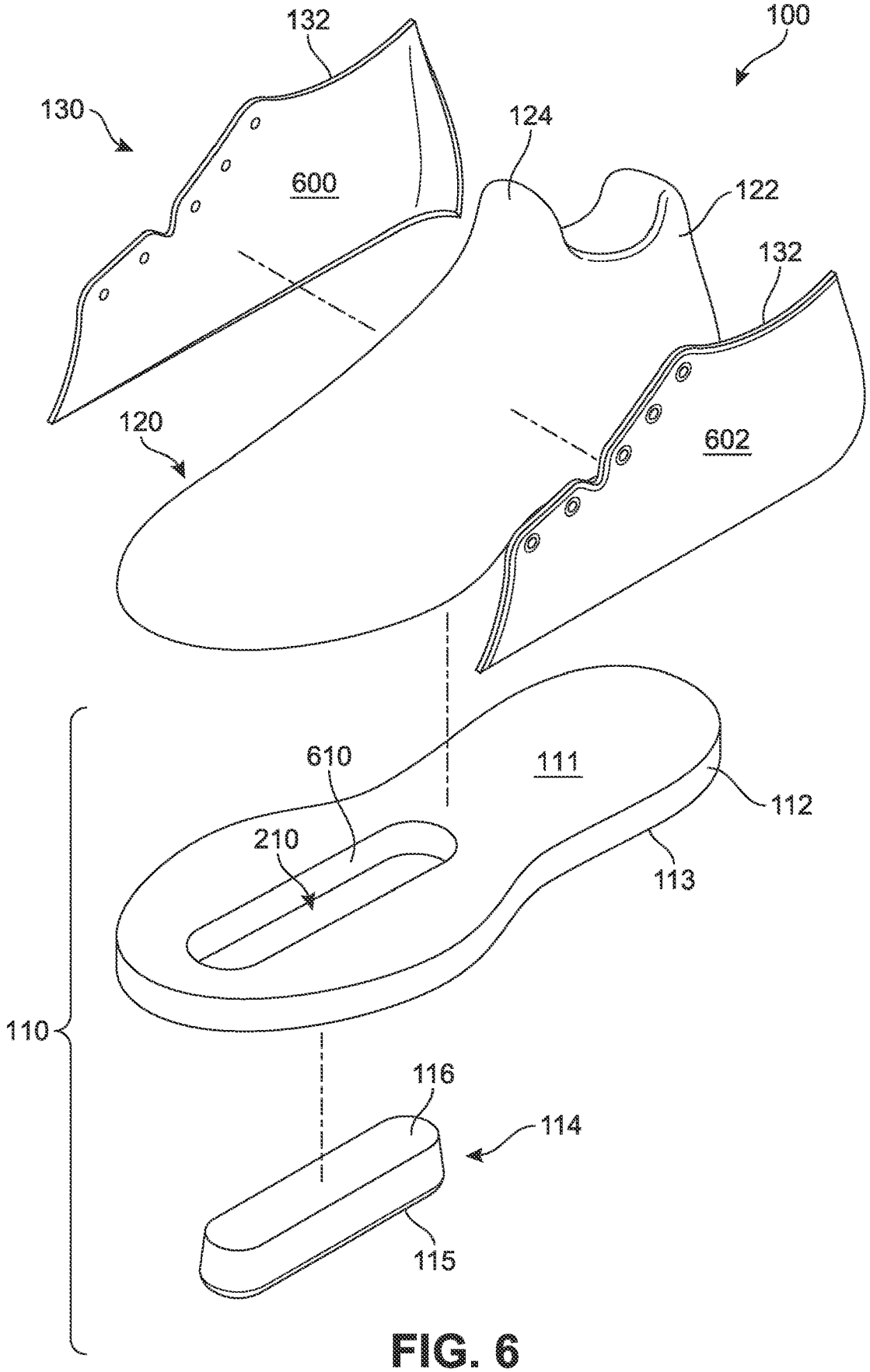
FIG. 6 is an exploded schematic view of the article of footwear including an exemplary embodiment of a sole structure having a central ridge element.

FIG. 6 illustrates an exploded isometric view of article 100, including components of each of sole structure 110, upper 120, and lacing system 130. As shown in FIG. 6, sole structure 110 includes central ridge element 114 and sole body portion 112. Sole body portion 112 includes aperture 210 that receives central ridge element 114. Aperture 210 is an approximately rectangular opening in sole body portion 112 that is delineated or outlined by a side wall 610 of sole body portion 112. Aperture 210 forms an opening that permits top surface 116 of central ridge element 114 to be attached to upper 120 and allow for independent movement of central ridge element 114 from sole body portion 112 when bottom surface 115 of central ridge element 114 contacts a surface.

In some embodiments, support wrap 132 of lacing system 130 may be provided by separate components for each of lateral side 16 and medial side 18 of upper 120. In this embodiment, support wrap includes a medial support portion 600 on medial side 18 and a lateral support portion 602 on lateral side 16. Together, medial support portion 600 and lateral support portion 602 form support wrap 132 and include plurality of lace apertures 134 for receiving lace 136. Support wrap 132 extends over the outside of bootie 122 and assists with fastening article 100 to a foot of a wearer. Support wrap 132, including each of medial support portion 600 and lateral support portion 602, may be joined to portions of sole structure 110, portions of upper 120, or both.

Figure 7:
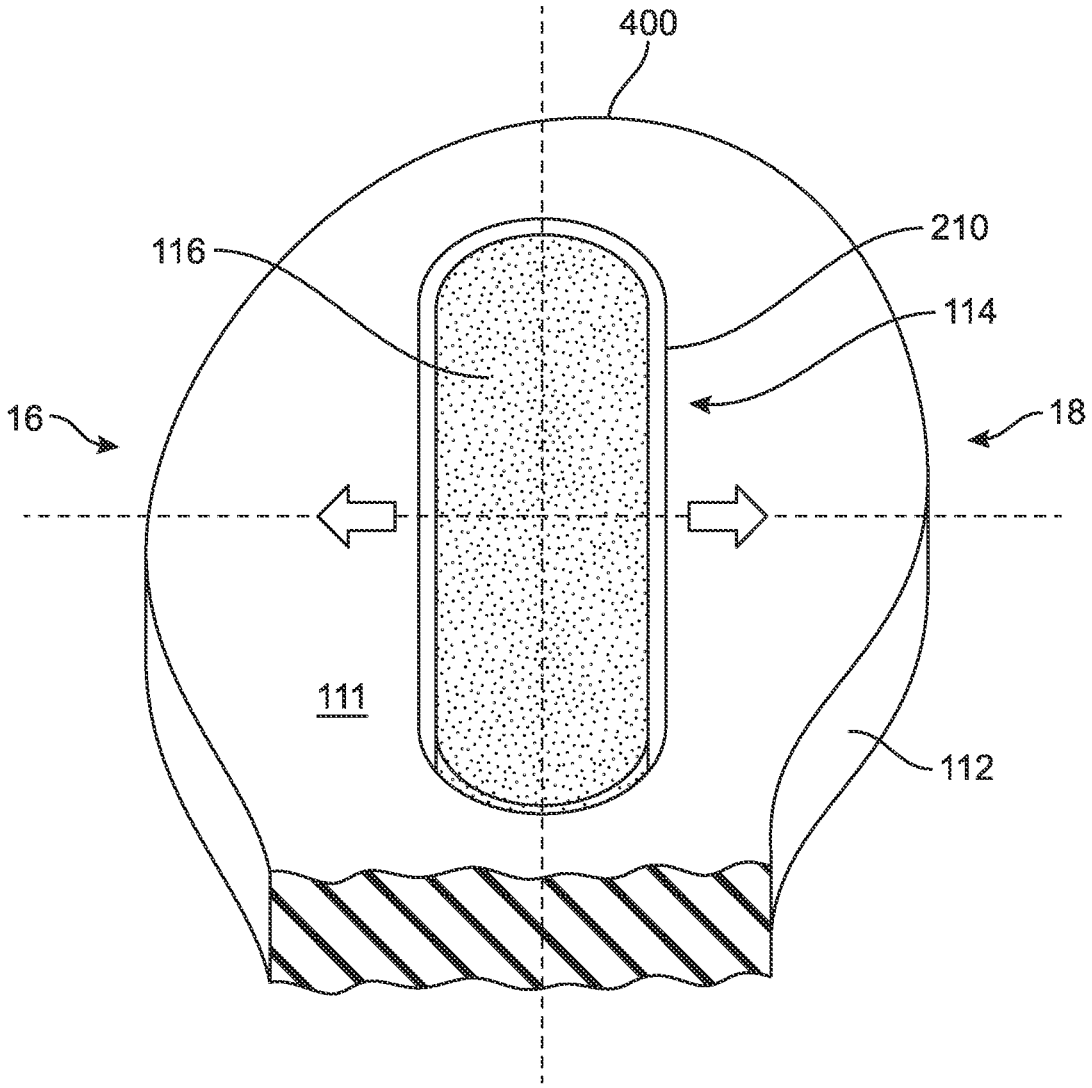
FIG. 7 is a representational view of the forefoot region of the sole structure having a central ridge element.

Referring now to FIG. 7, a representation of using central ridge element 114 as a directional force indicator to provide sensory feedback useful to determine the direction or orientation of weight or forces exerted on the wearer's foot is illustrated. In this embodiment, lateral and medial directions are illustrated corresponding to each of lateral side 16 and medial side 18. In some embodiments, central ridge element 114 may also undergo a rocking motion back and forth along the longitudinal direction. It should be understood that other directions that are orientated along combinations of longitudinal and lateral directions are also possible and may be similarly felt and sensed by the foot of the wearer according to the principles described herein.

With this arrangement, rocking or displacement of central ridge element 114 within aperture 210 in sole body portion 112 can be used to provide sensory feedback to the wearer about the movement or orientation of forces being applied to the wearer's foot. In this manner, central ridge element 114 can act as a directional force indicator that is used as reference for the foot to determine lateral and medial motion relative to the location of central ridge element 114 provided by the sensory feedback from central ridge element 114 felt by the wearer's foot. This sensory feedback can assist with the wearer's awareness of relative lateral motion and force balance during a sport or athletic activity. Additionally, central ridge element 114 underlying the foot of the wearer can provide a "push off" surface for the foot within the interior of the article of footwear to assist with making athletic maneuvers or cutting motions.

Figure 8:
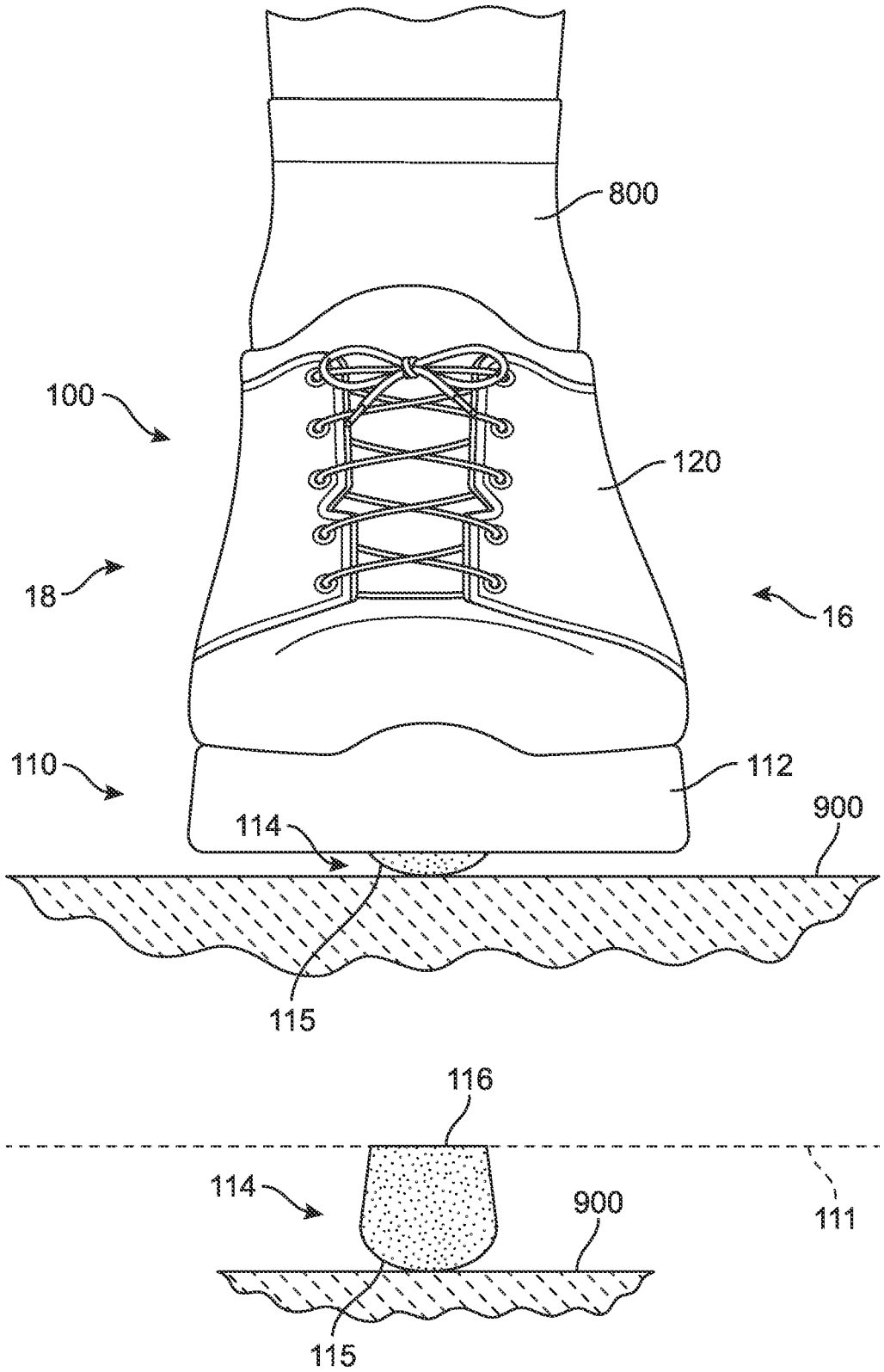
FIG. 8 is a representational view of a foot within the article of footwear with a central ridge element in an uncompressed condition.
Figure 9:
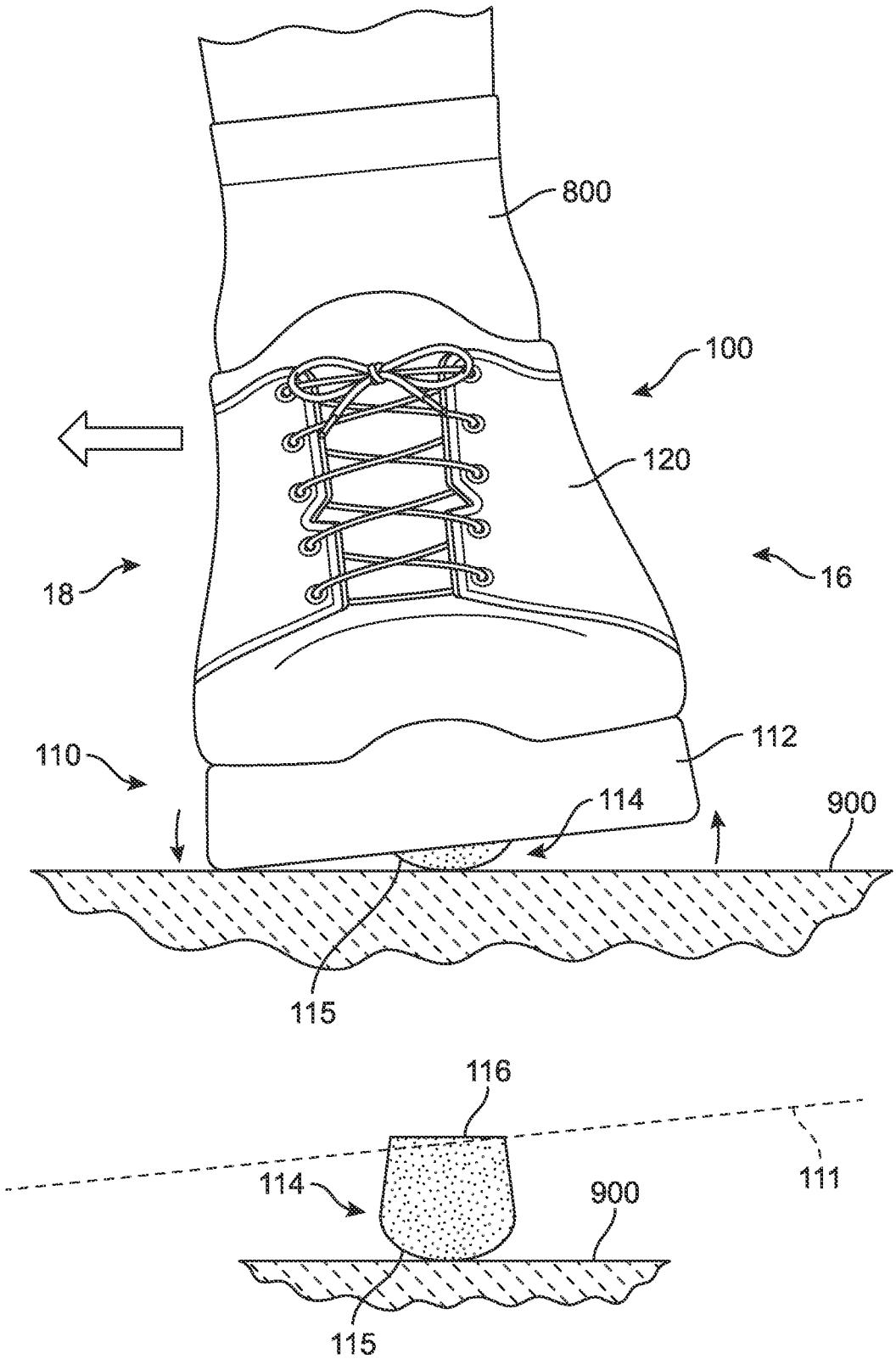
FIG. 9 is a representational view of a foot within the article of footwear with a central ridge element in a first compressed condition.
Figure 10:
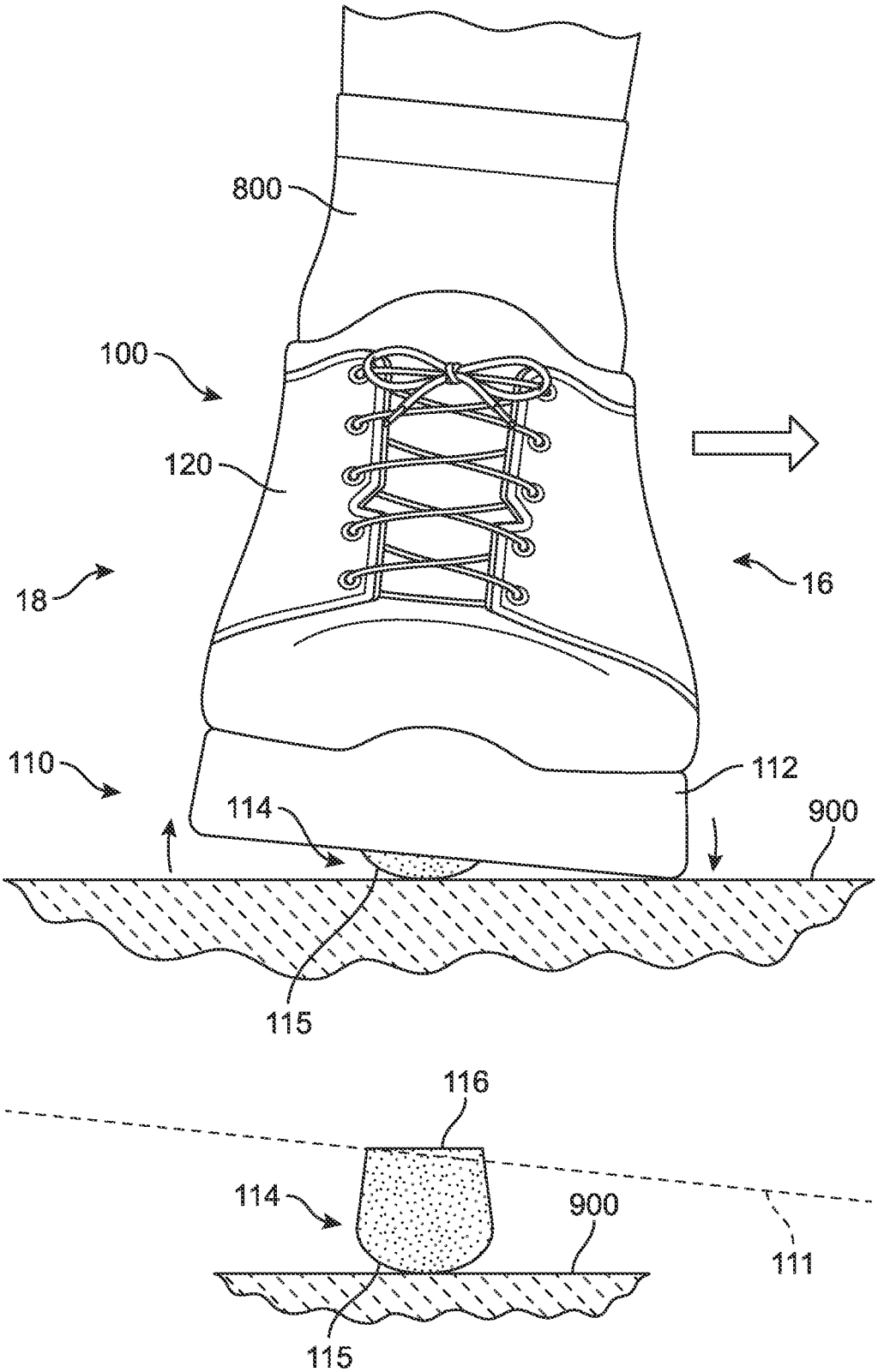
FIG. 10 is a representational view of a foot within the article of footwear with a central ridge element in a second compressed condition.

FIGS. 8-10 illustrate various examples of lateral and medial sensory feedback that may be provided to a foot of a wearer by sole structure 110 and central ridge element 114. Referring now to FIG. 8, a foot 800 is shown disposed with the interior void of upper 120 in article 100. Article 100 is shown here in an uncompressed condition before article 100 is placed in contact with a ground surface 900. In this uncompressed condition, central ridge element 114 has top surface 116 that is approximately flush or even with upper surface 111 of sole body portion 112. Central ridge element 114 is located within aperture 210 in sole body portion 112 in an uncompressed condition.

As foot 800 wearing article 100 steps onto ground surface 900, article 100 is placed in a compressed condition. Referring now to FIG. 9, article 100 is shown being compressed by foot 800 against ground surface 900. In various cases, athletic motions by the wearer may cause a shift of force or balance on a wearer's foot against ground surface 900 in the compressed condition along the lateral direction towards one of lateral side 16 or medial side 18. In this embodiment, a medial force in the direction of medial side 18 may be applied by foot 800 in article 100 against ground surface 900. As shown in the enlarged view in FIG. 9, this medial force causes a portion of central ridge element 114 to be displaced within aperture 210 relative to sole body portion 112. In this case, a medial side portion of top surface 116 of central ridge element 114 is raised above upper surface 111 of sole body portion 112 as bottom surface 115 of central ridge element 114 contacts ground surface 900.

Referring now to FIG. 10, in this embodiment, a lateral force in the direction of lateral side 16 may be applied by foot 800 in article 100 against ground surface 900. As shown in the enlarged view in FIG. 10, this lateral force causes a portion of central ridge element 114 to be displaced within aperture 210 relative to sole body portion 112. In this case, a lateral side portion of top surface 116 of central ridge element 114 is raised above upper surface 111 of sole body portion 112 as bottom surface 115 of central ridge element 114 contacts ground surface 900.

With this arrangement, sensory feedback regarding the direction of lateral force of balance of foot 800 relative to article 100 and ground surface 900 may be provided to the wearer.

Figure 11:
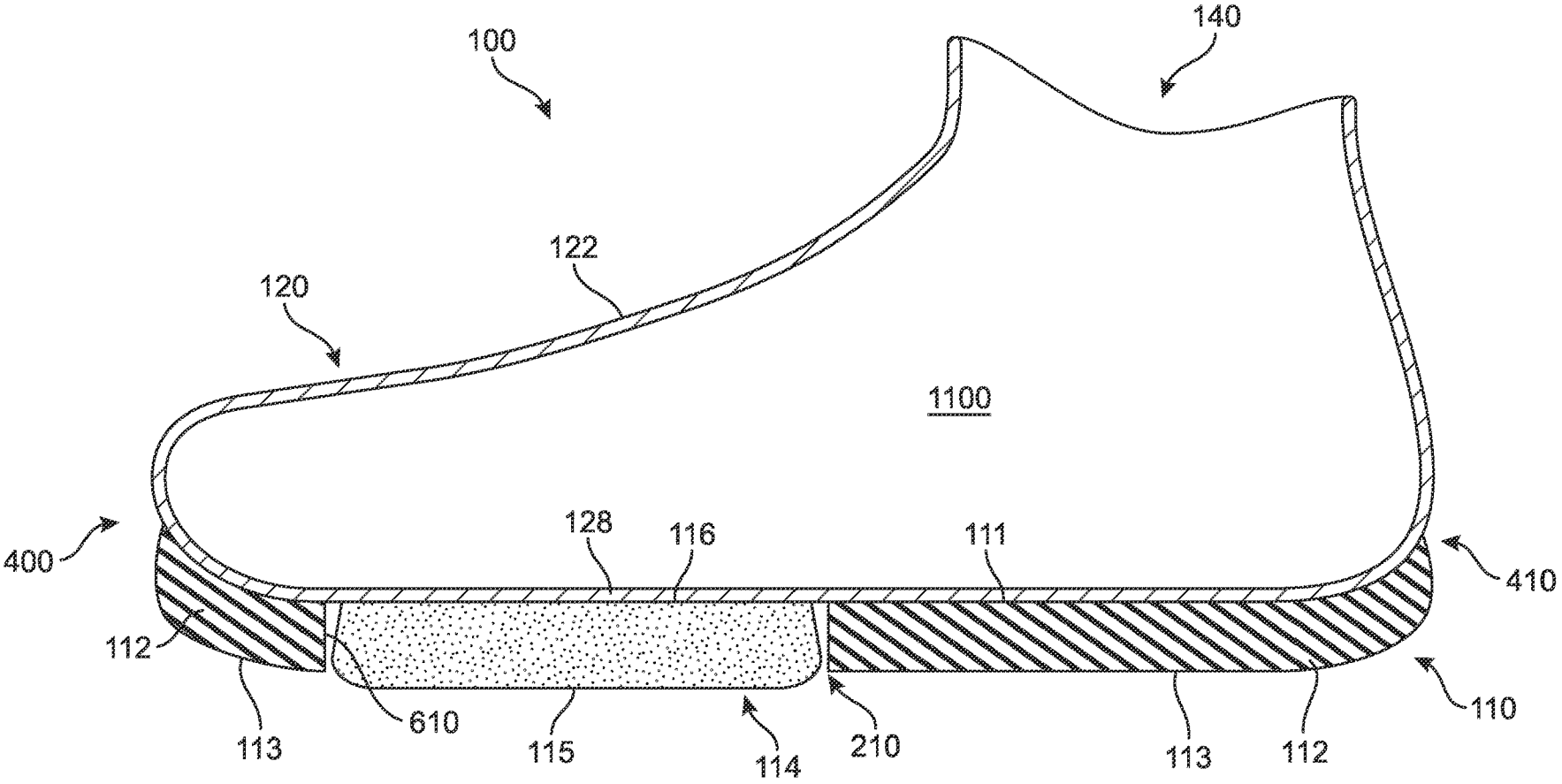
FIG. 11 is a representational longitudinal cross-section view of the article of footwear with a central ridge element.
Figure 12:
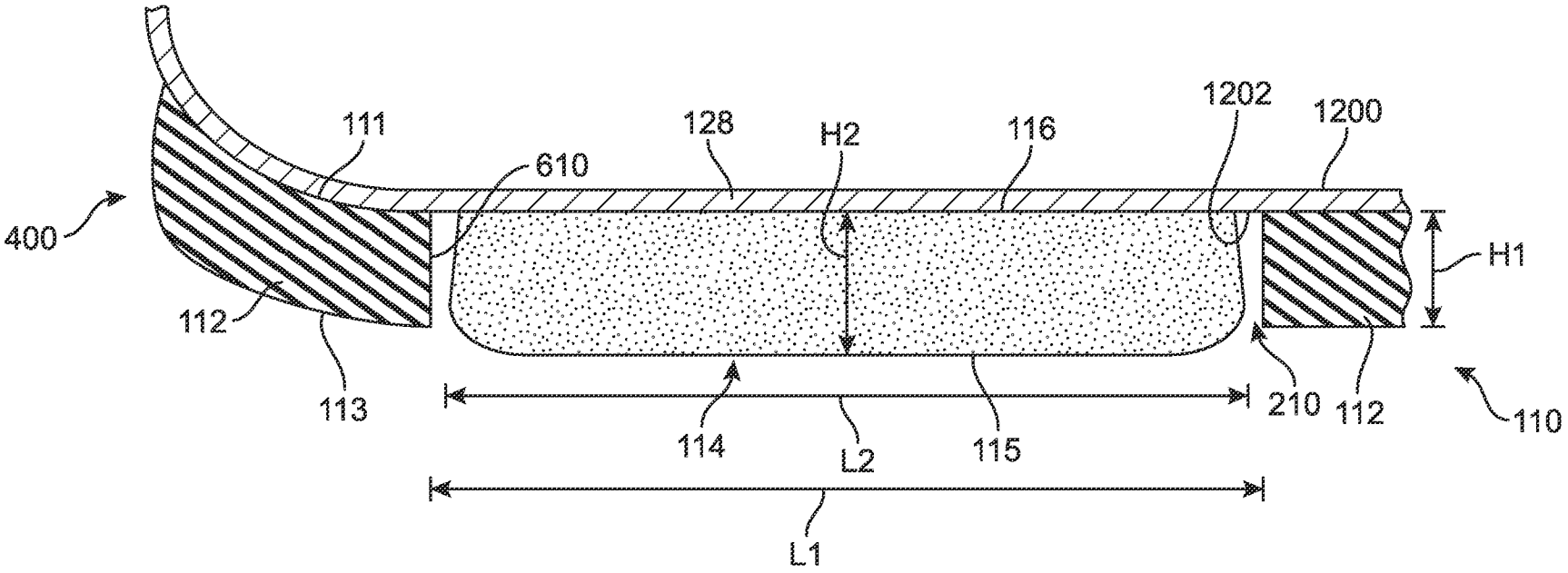
FIG. 12 is an enlarged representational longitudinal cross-section view of a portion of the sole structure with the central ridge element.

In other embodiments, athletic motions such as cutting or turning can primarily include transverse or lateral movements. FIGS. 11 and 12 illustrate examples of lateral side to side (i.e., lateral to medial) shift of force or balance on foot 800. In these embodiments, as force is directed towards lateral side 16 (FIG. 11) or towards medial side 18 (FIG. 12), the opposite side of top surface 116 of central ridge element 114 can be raised above upper surface 111 of sole body portion 112. With this arrangement, central ridge element 114 can provide sensory feedback regarding movements and force orientation in the lateral direction to foot 800 of the wearer. This type of sensory feedback may be helpful in assisting a wearer in determining the orientation and direction of forces of the foot over the sole structure of the article of footwear before making any additional athletic moves or motions.

It should be understood that many motions or movements made while playing a sport or performing an athletic activity may involve a combination of forces and motions that include longitudinal and/or lateral movements together. The central ridge element of the present invention may be used as described with reference to any or all of the movements illustrated in FIGS. 8-10 to provide sensory feedback to the wearer about the direction and orientation felt during a sport or athletic activity. In addition, as noted above, central ridge element 114 may also rock or wobble in the longitudinal direction to assist with sensory feedback of forward and rearward forces in the longitudinal direction. By providing sensory feedback to the wearer that assists with locating and determining relative motion and force balance, the wearer's awareness may be improved. Additionally, central ridge element 114 can extend into the interior of article 100 and provide the wearer's foot with a "push off" surface for making athletic maneuvers or cutting motions.

In some embodiments, bootie 122 forming upper 120 can be joined to sole body portion 112 and central ridge element 114. As shown in FIG. 11, base layer 128 is a bottom portion of bootie 122 that is configured to extend under a foot of a wearer within interior void 1100 of upper 120. Base layer 128 is joined to upper surface 111 of sole body portion 112 and also joined to top surface 116 of central ridge element 114. In this embodiment, central ridge element 114 is shown within respective aperture 210 in sole body portion 112. This arrangement allows top surface 116 of central ridge element 114 to be attached to base layer 128 of bootie 122. Additionally, central ridge element 114 is not attached or joined to sole body portion 112 so that central ridge element 114 is permitted to wobble and independently move in at least a vertical direction within aperture 210 in sole body portion 112. While central ridge element 114 may contact portions of side wall 610 when moving within aperture 210, central ridge element 114 is independent from sole body portion 112 and can move separate from sole body portion 112.

An enlarged view of a portion of sole structure 110 including central ridge element 114 is illustrated in FIG. 12. In an exemplary embodiment, sole body portion 112 may have a first height H1. First height H1 corresponds to the thickness of sole body portion 112 in the vertical direction extending between the foot of the wearer and the ground. Central ridge element 114 may have a second height H2 that corresponds to the height or thickness of the central ridge element in the same vertical direction. In this embodiment, second height H2 of central ridge element 114 is larger than first height H1 of sole body portion 112. With this arrangement, bottom surface 115 of central ridge element 114 extends above outsole surface 113 of sole body portion 112 such that bottom surface 115 of central ridge element 114 will generally initially contact the ground before outsole surface 113 of sole body portion 112.

In this embodiment, side wall 610 of aperture 210 in sole body portion 112 defines an approximately rectangular opening in sole body portion 112 that has a first length L1 extending along the longitudinal direction of sole structure 110. Central ridge element 114 is located within the opening defined by aperture 210 and has a second length L2. In some cases, central ridge element 114 has a trapezoidal prism shape, with second length L2 larger than a second width W2, discussed below. Second length L2 of central ridge element 114 is smaller than first length L1 of the opening defined by aperture 210. With this arrangement, central ridge element 114 may fit within aperture 210 of sole body portion 112 and have at least some clearance with side wall 610 of aperture 210.

Figure 13:
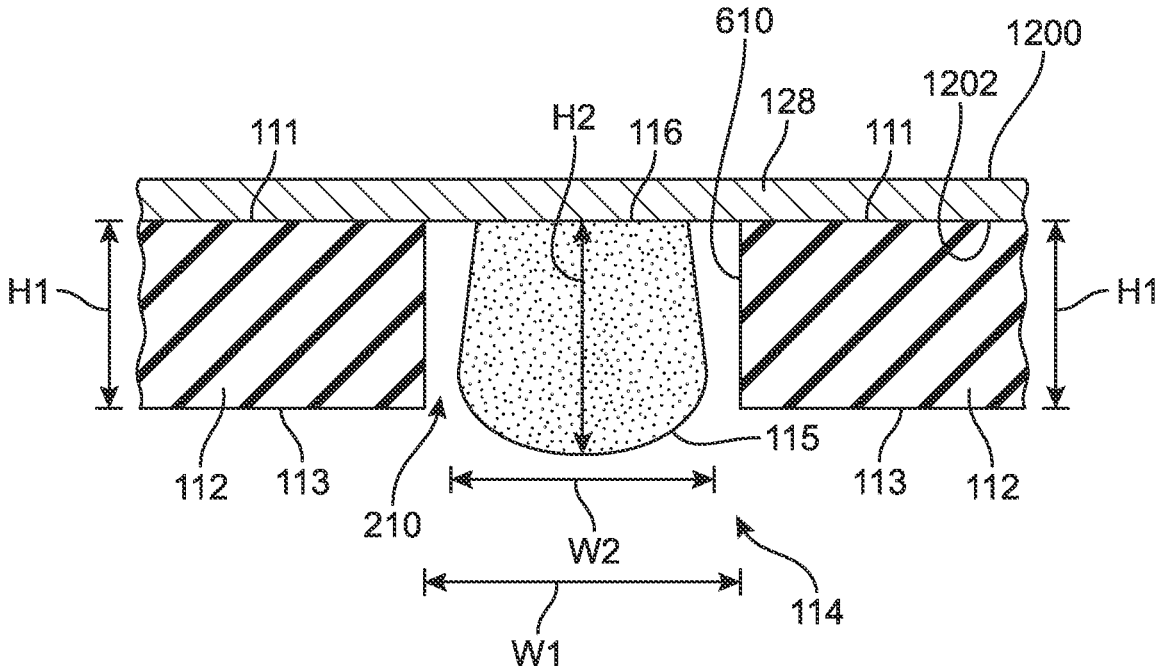
FIG. 13 is an enlarged cross-section view of a central ridge located within an aperture in the sole structure in an uncompressed condition.

As shown in FIG. 13, side wall 610 of aperture 210 in sole body portion 112 defining the approximately rectangular opening in sole body portion 112 also has a first width W1. Central ridge element 114 is located within this rectangular opening defined by aperture 210 and has a second width W2. In this case, central ridge element 114 has a trapezoidal prism shape, second width W2 of central ridge element 114 is smaller than second length L2. Second width W2 of central ridge element 114 is smaller than first width W1 of the opening defined by aperture 210. With this arrangement, central ridge element 114 may fit within aperture 210 of sole body portion 112 and have at least some clearance with side wall 610 of aperture 210.

Figure 14:
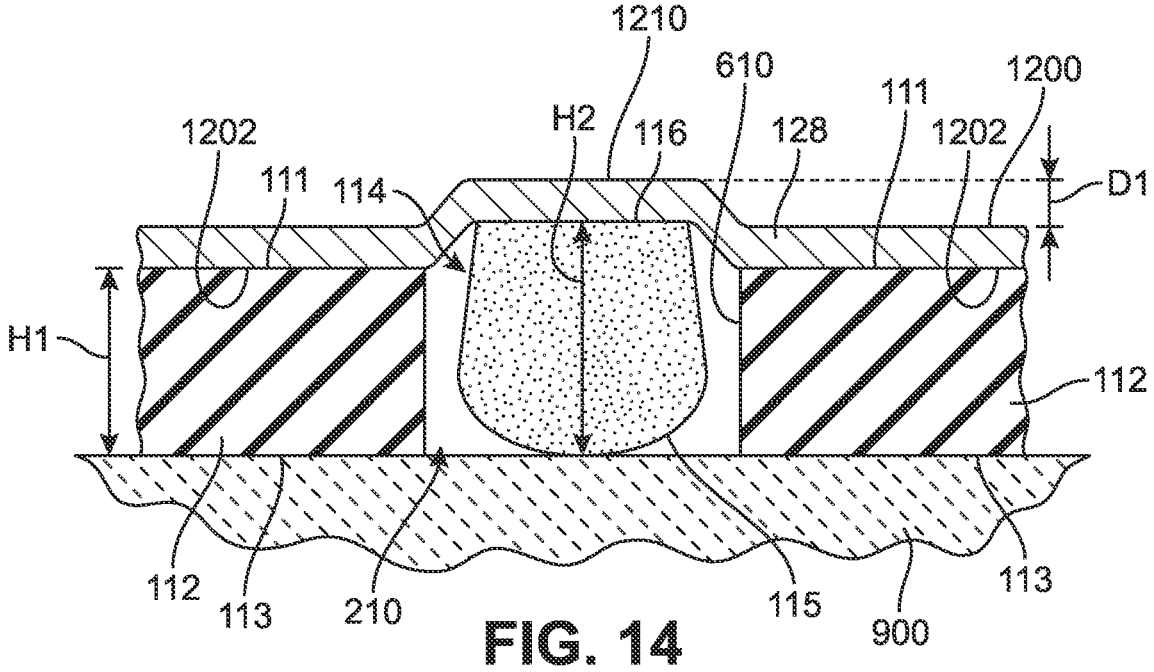
FIG. 14 is an enlarged cross-section view of a central ridge located within an aperture in the sole structure in a compressed condition.

FIGS. 13 and 14 illustrate the isolated motion of central ridge element 114 relative to sole body portion 112 and base layer 128 of bootie 122. Referring again to FIG. 13, central ridge element 114 is located in aperture 210 of sole body portion 112 and moves at least vertically within aperture 210 independently from sole body portion 112. That is, while portions of central ridge element 114 may contact portions of sole body portion 112, such as side wall 610, when central ridge element 114 moves through aperture 210, sole body portion 112 and central ridge element 114 are not directly joined or attached to each other. With this arrangement, central ridge element 114 is able to wobble and move independently of sole body portion 112 and central ridge element 114 can be displaced vertically relative to outsole surface 113 of sole body portion 112.

In this embodiment, base layer 128 of bootie 122 includes an inner surface 1200 facing towards the interior void 1100 (shown in FIG. 11) of upper 120 and an outer surface 1202 facing away from article 100 and towards the ground. Outer surface 1202 of base layer 128 is attached to upper surface 111 of sole body portion 112 and also attached to top surface 116 of central ridge element 114.

In FIG. 13, central ridge element 114 is shown in an uncompressed condition so that top surface 116 is approximately even or flush with upper surface 111 of sole body portion 112. Similarly, in the area of bootie 122 shown in FIG. 13, inner surface 1200 of base layer 128 also has an approximately uniform or even height above both top surface 116 and upper surface 111.

Referring now to FIG. 14, central ridge element 114 is shown in a compressed condition, for example, during a lateral movement as described with reference to FIGS. 8-10 above. In the compressed condition, bottom surface 115 of central ridge element 114 contacts ground surface 900 and bottom surface 115 of central ridge element 114 moves closer towards outsole surface 113 of the sole body portion 112. This movement also forces top surface 116 of central ridge element 114 upwards against outer surface 1202 of base layer 128. Central ridge element 114 is permitted to move independently of sole body portion 112 through aperture 210, causing the localized area of base layer 128 that is attached to top surface 116 of central ridge element 114 to be moved upwards to form a raised inner surface 1210 of base layer 128. Raised inner surface 1210 can then contact the underside of a foot of a wearer to provide the sensory feedback about movement or direction of forces relative to ground surface 900.

In this embodiment, raised inner surface 1210 extends above inner surface 1200 by a first distance D1. First distance D1 is approximately equal to the difference between second height H2 of central ridge element 114 and first height H1 of sole body portion 112. That is, the amount that top surface 116 of central ridge element 114 raises base layer 128 so that raised inner surface 1210 extends above inner surface 1200 when in the compressed condition is approximately the same as the amount that bottom surface 115 of central ridge element 114 extends above outsole surface 113 of sole body portion 112 when article 100 is in the uncompressed condition.

With this configuration, the amount of first distance D1 can be configured as desired based on selection of first height H1, second height H2, or both. For example, in some cases, the distance of raised inner surface 1210 of base layer 128 may be higher or lower to contact portions of the foot of the wearer. Selection of a larger or smaller first height H1 for sole body portion 112 and/or a smaller or larger second height H2 for central ridge element 114 can accommodate different distances needed for raised inner surface 1210 to contact a foot.

Figure 15:
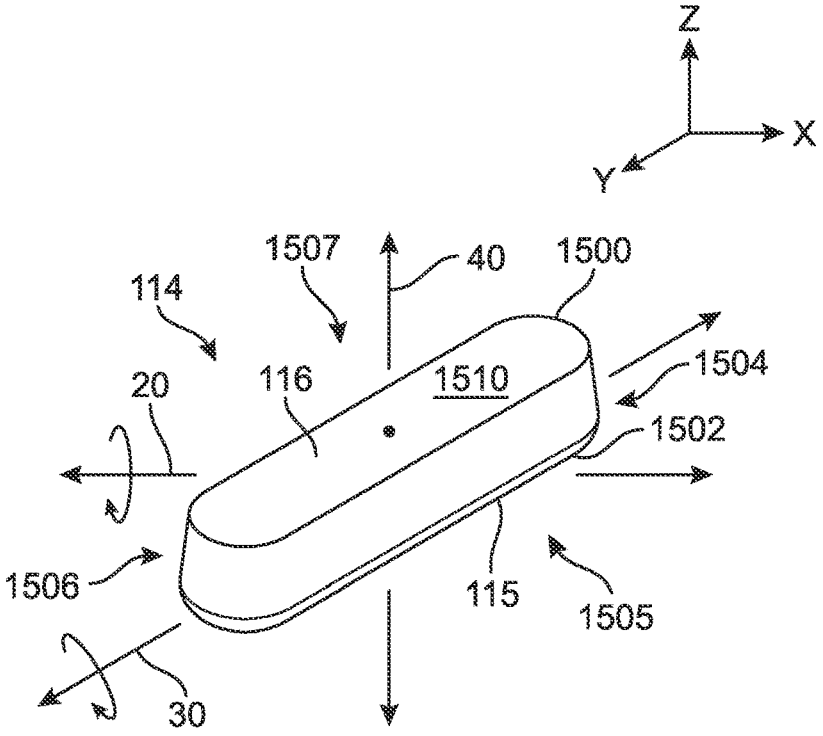
FIG. 15 is a representational view of an exemplary central ridge element.
Figure 16:
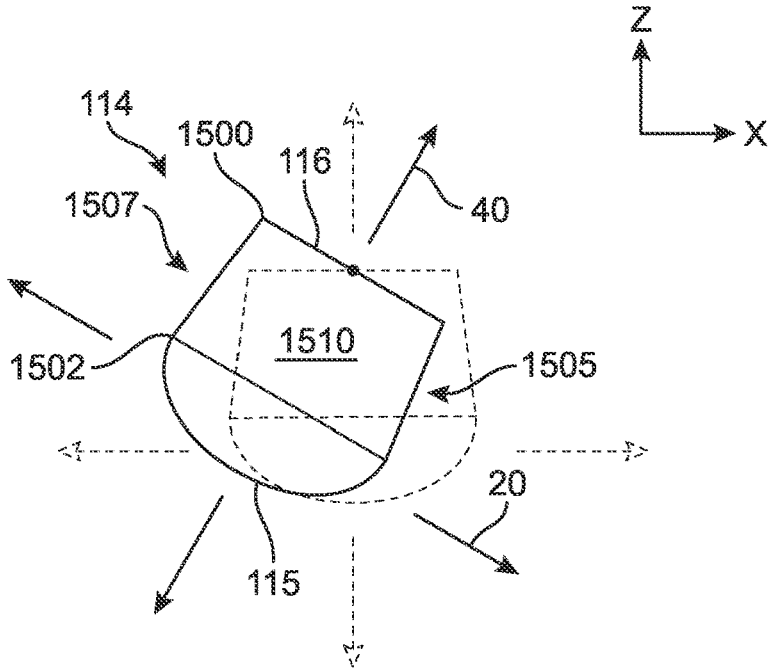
FIG. 16 is a representational view of an exemplary central ridge element wobbling about axes.

FIGS. 15 and 16 illustrate an exemplary embodiment of central ridge element 114. In this embodiment, central ridge element 114 includes a top end 1500 where top surface 116 is located and a bottom end 1502 where bottom surface 115 is located. A body portion 1510 of central ridge element 114 extends between top end 1500 and bottom end 1502 and includes a front end 1506 and a back end 1504 extending along a longitudinal length of central ridge element 114. Body portion 1510 also includes a first side 1505 and a second side 1507. In one embodiment, top end 1500 has a smaller area (i.e., a smaller width and a smaller length than the opposite bottom end 1502 so as to define an approximately trapezoidal prism shape of central ridge element 114. In different embodiments, the distance between top end 1500 and bottom end 1502 can vary so as to vary the length of body portion 1510 and, thereby, the height of central ridge element 114. In an exemplary embodiment, bottom surface 115 of central ridge element 114 is convex. In one embodiment, bottom surface 115 of central ridge element 114 may be approximately hemispherical. In other embodiments, however, the shape of central ridge element 114 may vary, including, but not limited to rectangular, triangular, cylindrical, spherical, round, and other geometric and non-geometric shapes. Additionally, in other embodiments, bottom surface 115 may be flat or uneven.

In this embodiment, the trapezoidal prism shape of central ridge element 114 and convex bottom surface 115 allow central ridge element to wobble about at least two axes. As shown in FIG. 15, central ridge element 114 has a first axis 20 aligned approximately with an x-axis, a second axis 30 aligned approximately with a y-axis, and a third axis 40 aligned approximately with a z-axis. In some embodiments, central ridge element 114 can wobble or move about two of first axis 20, second axis 30, and/or third axis 40. In some cases, the x-axis may be associated with a lateral direction of article 100, the y-axis may be associated with a longitudinal direction of article 100, and the z-axis may be associated with a vertical direction of article 100. It should be understood, however, that the designation and selection of coordinate systems may be varied.

For example, as shown in FIG. 16, central ridge element 114 is shown wobbling about at least two axes so that the orientation of bottom surface 115 and top surface 116 is changed. Wobbling of central ridge element 114 can be caused by the transmission of forces or instability of the ground surface relative to article 100. With this configuration, central ridge element 114 can wobble about at least two axes within aperture 210 in the sole body portion 112 to transmit sensory feedback to a foot of a wearer.

In previous embodiments, base layer 128 of bootie 122 is shown attached to top surface 116 of central ridge element 114 and upper surface 111 of sole body portion 112. In some cases, outer surface 1202 of base layer 128 can be attached to upper surface 111 of sole body portion 112 up to the edge of side wall 610 at the opening defining aperture 210. For example, as shown in FIGS. 13 and 14. In other cases, a predetermined amount of slack or give to accommodate the upwards vertical motion of top surface 116 of central ridge element 114 may be provided to base layer 128 by keeping a portion of outer surface 1202 of base layer 128 unattached to upper surface 111 of sole body portion 112.

Figure 17:
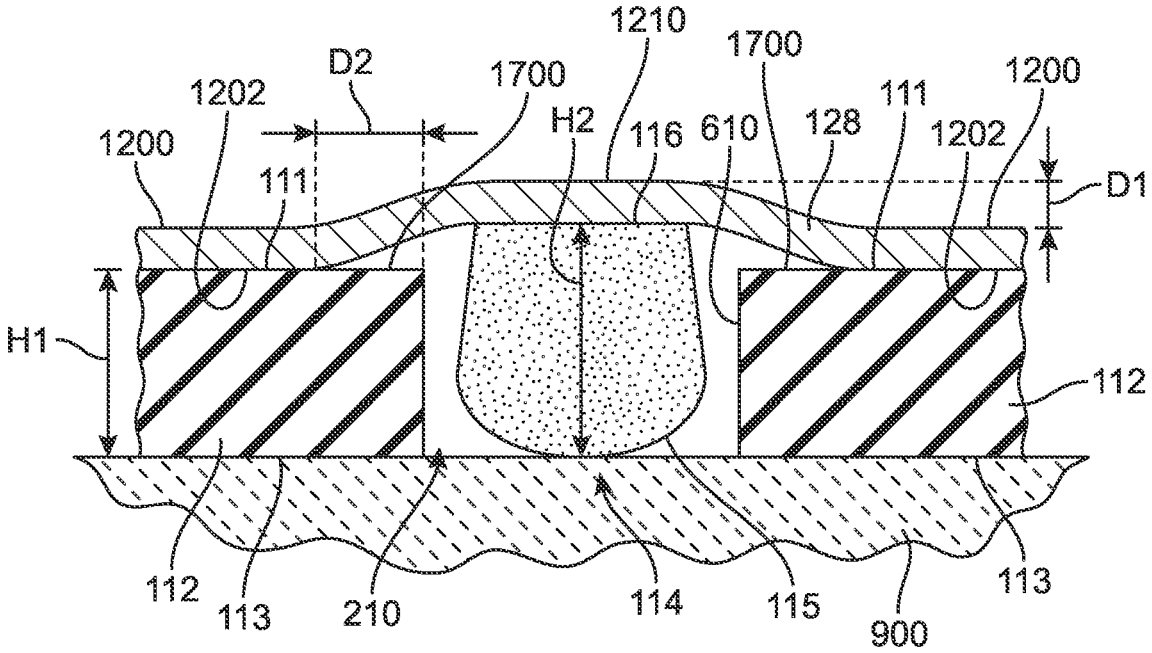
FIG. 17 is an enlarged cross-section view of an alternate embodiment of a central ridge element located within an aperture in the sole structure.

Referring now to FIG. 17, outer surface 1202 of base layer 128 remains unattached to upper surface 111 of sole body portion 112 along a margin 1700 located at a predetermined distance D2 from side wall 610 surrounding aperture 210 in sole body portion 112. Margin 1700 permits base layer 128 to have a predetermined amount of slack or give to accommodate the upwards vertical motion of top surface 116 of central ridge element 114 when in the compressed condition. As shown in FIG. 17, margin 1700 extending predetermined distance D2 from side wall 610 around aperture 210, allows inner surface 1200 of base layer 128 to rise to raised inner surface 1210.

In some embodiments, base layer 128 may be formed from a flexible or stretchable layer or membrane, including materials made of elastic, rubber, woven or knit textiles, or other suitable flexible materials. In such cases, base layer 128 may stretch as needed to accommodate the upwards vertical motion of top surface 116 of central ridge element 114 when in the compressed condition. Additionally, such flexible or stretchable layer may be resilient to assist with forcing central ridge element 114 back to the uncompressed condition when force from a foot has been removed. However, in other embodiments, base layer 128 may need to accommodate additional displacement or increased sensitivity that may be lost if using a material that is too resilient. Additionally, in other embodiments, base layer 128 may be made from a non-stretchable or inflexible material. Accordingly, in these other embodiments, the alternate embodiment of attaching base layer 128 to upper surface 111 of sole body portion 112 using margin 1700, as described in reference to FIG. 17 above, may assist with upwards vertical motion of top surface 116 of central ridge element 114 when in the compressed condition.

While various embodiments of the invention have been described, the description is intended to be exemplary, rather than limiting and it will be apparent to those of ordinary skill in the art that many more embodiments and implementations are possible that are within the scope of the invention.

Accordingly, the invention is not to be restricted except in light of the attached claims and their equivalents. Also, various modifications and changes may be made within the scope of the attached claims.

We claim:

1. A sole structure for an article of footwear, the sole structure comprising:

a sole body portion, the sole body portion including an outsole surface facing away from the article of footwear and an upper surface disposed opposite the outsole surface;

an aperture in the sole body portion having an aperture thickness defined by a top opening at the upper surface and a bottom opening at the outsole surface, the aperture also having an aperture width at the bottom opening; and a longitudinally-extending central ridge element disposed within the aperture, the central ridge element having a bottom surface that extends below the bottom opening of the aperture to engage a ground surface, wherein a width of the central ridge element is substantially constant along a length of the central ridge element, and the width of the central ridge element is less than the aperture width, wherein the central ridge element has a first end near a toe end in a forefoot region of the sole structure and a second end in a midfoot region of the sole structure, wherein, when the bottom surface of the central ridge element engages the ground surface, the central ridge element can move vertically and horizontally relative to the aperture to transmit sensory feedback to a foot of a wearer of the article of footwear.

2. The sole structure of claim 1, wherein the width of the central ridge element is equal to or less than half the length of the central ridge element.

3. The sole structure of claim 1, wherein the width of the central ridge element is 1.5 inches or less and the length of the central ridge element is 6 inches or less.

4. The sole structure of claim 3, wherein the width of the central ridge element is 0.75 inches or greater and the length of the central ridge element is 2.5 inches or greater.

5. The sole structure of claim 1, wherein the bottom surface of the central ridge element is convex.

6. The sole structure of claim 5, wherein the bottom surface of the central ridge element is approximately hemispherical.

7. The sole structure of claim 1, wherein the central ridge element is configured to move vertically within the aperture in the sole body portion so that the bottom surface of the central ridge element moves closer to the outsole surface of the sole body portion when the central ridge element engages with the ground surface.

8. The sole structure of claim 1, further comprising a base layer attached to the upper surface of the sole body portion, wherein the top surface of the central ridge element is attached to the base layer.

9. The sole structure of claim 8, wherein the base layer is unattached to the upper surface of the sole body portion at the aperture and at an area surrounding the aperture.

10. The sole structure of claim 1, wherein the aperture is approximately evenly spaced from a medial perimeter edge and a lateral perimeter edge of the sole structure.

11. An article of footwear, the article of footwear comprising:

an upper;

a sole structure joined to the upper, the sole structure comprising:

a sole body portion, the sole body portion including an outsole surface facing away from the article of footwear and an upper surface disposed opposite the outsole surface; and an aperture in the sole body portion having an aperture thickness defined by a top opening at the upper surface and a bottom opening at the outsole surface, the aperture also having an aperture width at the bottom opening;

a longitudinally-extending central ridge element disposed within the aperture, the central ridge element having a bottom surface that extends below the bottom opening of the aperture to engage a ground surface and a base layer attached to the upper surface of the sole body portion, wherein a top surface of the central ridge element is attached to the base layer and a width of the top surface of the central ridge element is less than a width of the top opening of the aperture, wherein the width of the central ridge element is substantially constant along a length of the central ridge element, and, wherein, when the bottom surface of the central ridge element engages the ground surface, the central ridge element can move vertically and horizontally relative to the aperture to transmit sensory feedback to a foot of a wearer of the article of footwear.

12. The article of footwear of claim 11, wherein the width of the central ridge element is between 0.75 inches and 1.5 inches, and the length of the central ridge element is between 2.5 inches and 6 inches.

13. The article of footwear of claim 11, wherein the central ridge element extends from an area near a toe end in a forefoot region to an area in a midfoot region.

14. The article of footwear of claim 11, wherein the central ridge element is configured to move vertically within the aperture in the sole body portion so that the bottom surface of the central ridge element moves closer to the outsole surface of the sole body portion when the central ridge element engages with the ground surface.

15. The article of footwear of claim 11, wherein the base layer is unattached to the upper surface of the sole body portion at the aperture and at an area surrounding the aperture.

16. The article of footwear of claim 15, wherein the base layer is a portion of the upper.

17. The article of footwear according to claim 11, wherein the base layer is an insole.

18. The article of footwear according to claim 11, wherein the base layer is a flexible material.

* * * * *